US006363844B1

(12) United States Patent
Anthony

(10) Patent No.: US 6,363,844 B1
(45) Date of Patent: Apr. 2, 2002

(54) MOBILE SYSTEM TO REPACKAGE COMPRESSIBLE MATERIALS

(75) Inventor: William S. Anthony, Greenville, MS (US)

(73) Assignee: The United States of America as represented by the Department of Agriculture, Washington, DC (US)

( * ) Notice: Subject to any disclaimer, the term of this patent is extended or adjusted under 35 U.S.C. 154(b) by 0 days.

(21) Appl. No.: 09/490,361

(22) Filed: Jan. 24, 2000

(51) Int. Cl.[7] ..... B65B 13/20; B65B 13/06
(52) U.S. Cl. ..... 100/7; 100/25; 100/226
(58) Field of Search ..... 100/3, 7, 25, 34, 100/226

(56) References Cited

U.S. PATENT DOCUMENTS 203,880 A * 5/1878 Blossom ..... 100/3
344,659 A * 6/1886 Johnson ..... 100/34 X
540,472 A * 6/1895 West ..... 100/3
3,590,731 A * 7/1971 Nichols ..... 100/3 X
3,613,567 A * 10/1971 Loughran ..... 100/3 X
5,852,969 A * 12/1998 Anthony ..... 100/3 X

* cited by examiner

*Primary Examiner*—Stephen F. Gerrity
(74) *Attorney, Agent, or Firm*—M. Howard Silverstein; Joseph A. Lipovsky; John D. Fado

(57) ABSTRACT

A device for the placement of bale ties, to effect repair of cotton bales which have been damaged as a result of bale tie failures. The device, which allows placement of multiple ties without individual bale movement, includes a base frame structure, an upper platen transversely locatable upon said base frame structure for paired contraposition with a lower platen, and a lower platen base attached to said base frame structure containing a plurality of lower platens mounted thereon that are able to reversibly recede therein when not needed for application of a localized compressive force. The platens are mounted on the structure for relative intraplanar movement toward and away from one another with the compression surfaces disposed in substantial parallelism. The platens are positioned for compressing a damaged cotton bale therebetween as the upper platen moves, by means of a reciprocating drive mechanism, toward its aligned opposite. The compression surfaces of the platens have a width which is sufficiently small to compress a damaged cotton bale only in close proximity to a position where a single replacement bale tie is to be placed.

8 Claims, 7 Drawing Sheets

MOBILE SYSTEM TO REPACKAGE COMPRESSIBLE MATERIALS

BACKGROUND OF THE INVENTION

1. Field of the Invention

This invention relates to the placement or replacement of restraining bale ties on bundles or bales of compressible solid material. Particular application exists with regard to the recompression of cotton bales to higher densities or the repair of cotton bales that have been damaged due to the loss or improper functioning of one or more bale ties.

2. Description of the Prior Art

Presently, approximately 85 million bales of cotton are produced worldwide with 18 to 20 million bales produced in the United States annually, each weighing about 500 pounds. In the United States they are formed in the typical cotton gin at the rate of one every 2 to 4 minutes. This is done by having the cotton fiber fed down an inclined plane into a preliminary tramping mechanism which forces the cotton into a typically rectangular enclosure. Once this enclosure contains the desired amount of cotton, it is then rotated to a second position where considerable compressive force is applied for baling.

Most gin presses have two rectangular enclosures, one to store cotton during ginning and the other to do the actual compression. The cotton bale is formed by its compression between a pair of 20×54-inch rectangular plates, or platens, to which a force ranging from about 150,000 to about 1,000,000 pounds is applied. The platens conventionally have six to eight groves therein that are about one-inch wide and two inches deep. These facilitate the insertion of bale ties once the bale is compressed to a density of about 42 pounds per cubic foot, which corresponds to a thickness of about 19 to 20 inches. These bale ties, typically comprising of round steel wires or flat straps made of steel or polyester, are then made to encircle the bale and their loose ends connected together. The compressive mechanism is then released and the bales are allowed to expand to a thickness that the restraining bale ties permit, this conventionally ranges from about 26 to 32 inches. Final bale dimensions are thus typically about 21 inches by 55 inches by 26 to 32 inches.

Compression to high densities requires large forces and. extensive mechanical and hydraulic systems which may not be economical for some gin operations. Mechanisms to achieve secondary compression from low to high density are unavailable.

Bale tie failures, caused by such factors as improper tie-off, improper matching of bale ties to compression density, uneven cotton distribution within the bale, low moisture content, defective ties, and improper storage or handling, are significant problems which plague the cotton industry. While specific statistics are not kept on the number of bale tie failures during a typical year, it is estimated that about 4% or over 800,000 bales, experience tie failures annually. Bale tie failure rates in excess of 10% annually have, however, been reported at some storage facilities. Typically, from one to four ties break in a given bale, thereby allowing it to expand from its original thickness of 26 to 32 inches up to about 38 to 42 inches. Bales damaged through loss of bale ties are rejected by mill customers due to their increased susceptibility to contamination and their loss of physical conformity to the mill's processing machinery.

Repair procedures in the past have included such approaches as recompression of the entire bale in conventional baling equipment or manually cinching a replacement tie around the bale. The deficits in these approaches are that use of the baling equipment requires that the gin not be processing cotton at the time, the bale expands to dimensions greater than the press opening and the bale must be completely unpackaged, and manual cinching may fail to adequately reconstrain the bale.

Warehouses handling cotton bales have been compelled, as a result of this situation, to dedicate expensive, large-scale bale presses for accomplishing bale tie replacement. Smaller gins and warehouses having insufficient bale tie failures to justify the major expenditures for a bale press must ship the defective bales to a gin or similar facility for repair at significant cost in order to make them acceptable for market. Aside from transportation, repair costs range from $10 to $45 per bale, depending on the availability of a bale press. This works out to a cost of $8 to $36 million for repairing of the 800,000 bales damaged annually.

U.S. Pat. No. 4,438,689 to Simich teaches a method to apply wires to a material baling device which comprises a pair of wide platens, each containing at least one recessed channel for use with placement of bale tie wires. The device includes a power feed assembly designed to guide the bale tie wires through the platen channels so that their placement and securing is made less labor intensive.

U.S. Pat. No. 4,509,416 to Simich teaches bale tie joining devices for securing bale tie ends on the top of the bale, wherein the completed tie joint or knot is readily visible to the press operator from the top prior to bale release.

U.S. Pat. No. 5,921,174 to Anthony teaches a method to replace broken bale ties which consists of inserting a portion of a bale lengthwise into a press, compressing a bale of cotton in a narrow area, emplacing a single bale tie, releasing the bale, and repeating the process.

SUMMARY OF THE INVENTION

The shortcomings of prior machines and methods for compressing bales and/or repairing bale tie failures are addressed and essentially minimized through the use of the device and methodology provided by the present invention. The device includes a base frame structure which is sufficiently compact so as to be readily transportable but large enough to accept an entire bale at it's widest dimension. The device further includes a platen base having transversely attached thereto one or more elongated platens, similar to those disclosed by Anthony in U.S. Pat. No. 5,921,174, issued Jul. 13, 1999; hereby incorporated by reference. These platens are affixed in a manner to allow them to be reversibly maintained above the platen base by tension means until such time as bale compression is initiated. Platens positioned in areas of desired compression are selectively "locked" in this extended conformation, while those at points where there is no desire to apply pressure, are allowed during operation to compressibly recede into the base platen. The device further includes an upper compressive platen that may be brought into aligned opposition with a selected lower platen and capable of movement toward and away from said opposed platen for purposes of applying a localized compressive force only in that area where a bale tie is to be attached.

In accordance with the invention, the platens are positioned for compressing a damaged bale therebetween by movement within the same plane toward one another. The compression surfaces of the platens each have a cross-sectional dimension in a direction perpendicular to the major axis thereof, which is sufficiently small so as to allow compression of a bale only in close proximity to the location on the bale where a bale tie is intended to be placed. The device further includes a drive mechanism that is mechanically coupled to the platens and is operable to move the platens relatively toward one another.

In accordance with a preferred form of the invention, a longitudinally extending bale tie receiving recess may be provided in at least one of the opposing platen compression surfaces. Advantageously, a longitudinally extending bale tie receiving recess may be provided in both of the opposing platen compression surfaces.

In a further embodiment of the present invention, one of the platen bases contains multiple platens spaced so as to span the length of the bale, each of which are supported above the platen base by compressible springs, reversibly deformable materials such as rubber, hydraulics or similar means that are sufficiently strong to withstand the weight of a bale without appreciable deflection.

In yet another embodiment of the present invention, a locking means is associated with each recessible platen so as to selectively prevent it from receding into the platen base when compressive forces are applied, thereby allowing all the available force to be applied specifically in the desired area.

In accordance with yet another embodiment of the instant invention, the tension means acting for the extension of each recessible platen is such that the platen will extend beyond the contact face of the platen base as compressive force is removed, thereby allowing the reversible "locking" of alternate platens for compressible contact with a bale.

In accordance with the invention, the drive mechanism may include one or more cylinder assemblies operable by any art known means including mechanical, hydraulic or pneumatic. This drive mechanism may, in the alternative, include one or more manually operated jacks.

In another form of the invention, the longitudinally extending bale contacting and compressing surfaces of the platens may be triangular in cross-section and present a v-shaped nose portion disposed to point toward a bale. Such a conformation concentrates and localizes the compression forces applied during the repair operation.

The device of the invention may also include a conveyor apparatus situated beside the base frame structure. Such a conveyor apparatus may be disposed so as to transport a damaged bale to a repair zone located between the platens.

The invention also provides a method for repairing bales which have been damaged as a result of bale tie failure. The method includes placing a damaged bale in a repair zone and thereafter compressing the damaged bale only in the area proximate to the positions where a bale tie is to be placed and, while the bale is compressed, installing the needed bale ties around the bale.

The device for compressing cotton bales in accordance with the invention provides a means for repairing defective bales of cotton on site and of further compressing bales without need for movement of the bale for repair of multiple ties. Only a single operator is required for a period of about 5 to 15 minutes to replace up to eight defective ties. This compares very favorably with known procedures and devices where as many as four operators are required for thirty minutes, using a full size baling press that currently markets for more than $300,000. The cost of the automatic device of the present invention, due to reduced energy and equipment requirements may be only about $40,000.

In accordance with the invention, repair may be accomplished without interruption of the ginning or warehouse operations. Repair may also be accomplished at a warehouse or textile mill where no bale press is available. Since bales from several gins are often consolidated at a central warehouse, repair may be accomplished at such a warehouse without interruption of the normal operations.

As will readily be recognized by those of ordinary skill in the art to which the present invention pertains, the device may be readily adapted for transport.

In accordance with the invention, the device for installing bale ties is intended to meet the needs of the individual cotton gin or warehouse.

DETAILED DESCRIPTION OF THE PREFERRED EMBODIMENTS

In accordance with the invention, an inexpensive, transportable device is provided for compressing bales or recompressing damaged bales only in the vicinity of the desired area, thereby allowing replacement of one or more bale ties. The device employs a compression platen that, in the case of cotton, is typically about 1.0 inches wide and about 21 inches long. One platen base includes transversely mounted thereon multiple platens that are able to reversibly recede therein when not needed for application of a localized compressive force. A longitudinally extending bale tie accommodating recess may be provided in the compression surface of each platen pair. This recess is dimensioned to accommodate the particular bale tie being used. In the case of cotton, a 0.25 inch width is desirable when conventional wire ties are being utilized; a wider recess width, typically about 0.75 inches, may be preferred in the case where bands are utilized as bale tie devices. The recess itself may be of any desired configuration such as a simple groove, however, in a preferred embodiment the recess has an inverted keyhole-type cross-section. This configuration allows for ready placement of the bale tie in the platen recess even after bale compression and the tie's ready release from the platen recess. Each platen of the preferred embodiment of the present invention provides a compression area of about 21 square inches, in contrast to the 1,080 square inches associated with the typical baling compressor platen. Broadly, the invention provides for the point application of compressive force at only those positions where a replacement tie is to be installed through the utilization of elongated compression platens having compression surfaces that are less than standard. This in turn minimizes the force needed to compress a damaged bale for repair and replacement of bale ties.

Bale ties may be individually placed in the recesses of the platens before the bale is moved into position for tie installation. After the bale is compressed at the localized area where a tie is to be placed, a new tie is inserted and the ends of the new tie are then joined together in a conventional manner. An advantage of the instant invention over the prior art is the use of platens which are reversibly maintained above the platen base by independent tension and locking means for the purpose of selectively applying a focused compressive force sufficient to allow placement of necessary bale ties without need for repetitive movement of the bale as each tie is applied.

Figure 1:
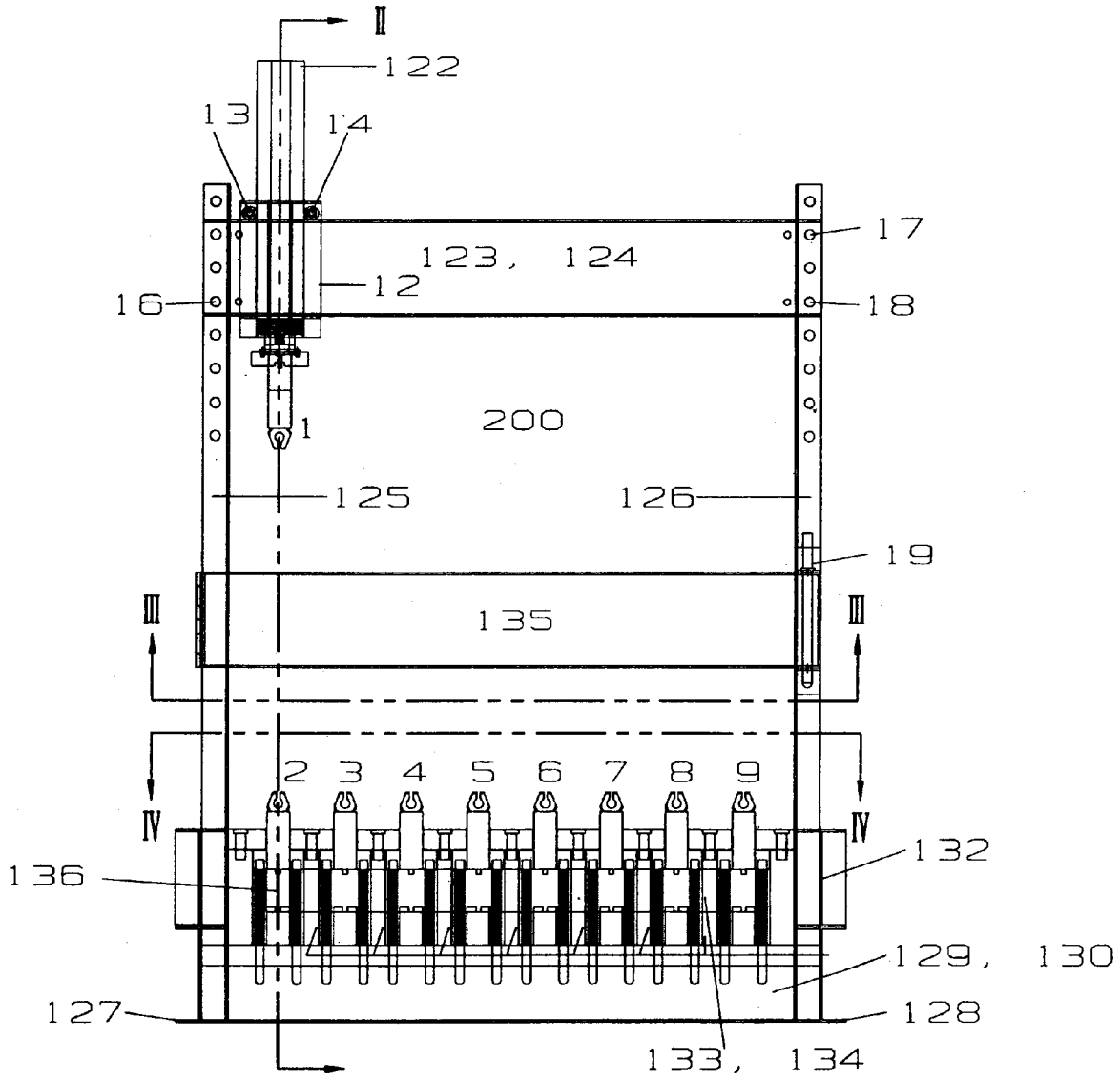
FIG. 1 is a front elevational view of an embodiment of the invention.

A device for placing bale ties in accordance with the present invention is illustrated in FIG. 1, and is broadly identified by the reference numeral 200. Device 200 includes a frame structure which is made up of a pair of beam members 125 and 126 and cross beam members 123, 124, 129, 130, 133, 134, 135 and 136 (see FIG. 1). The beam members are preferably constructed from iron or steel and may be C-shaped as shown. The dimensions of the beam members are not critical so long as the frame has sufficient strength and rigidity to withstand the forces exerted in reaction to the application of compressive forces on a bale by the platens.

Figure 2:
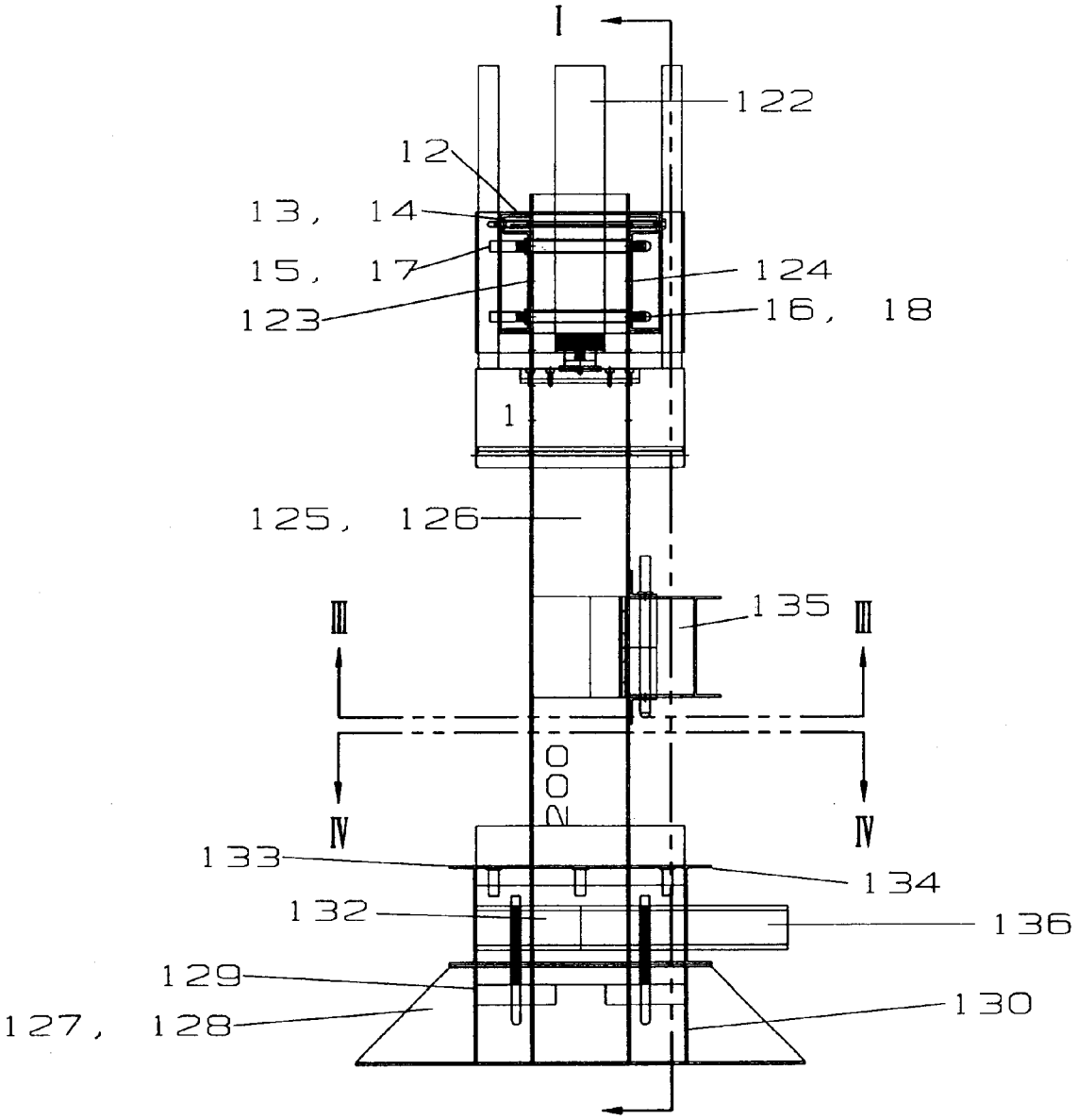
FIG. 2 is a side elevational view of the invention looking leftward at the device of FIG. 1.

The lower cross beam members 129, 130, 133 and 134, may be attached to the beam members 125 and 126, by any conventional means such as mechanical fasteners or by welding. The upper cross beam members 123 and 124, are removably secured to beam members 125 and 126, using a fastening means such as pins (see FIG. 2), which facilitate longitudinal adjustment of the position of the cross beam members 123 and 124, relative to beam members 125 and 126. For this purpose, a series of holes 16–18, may be provided in the flanges of beam members 129, 130, 133 and 134, respectively.

Figure 3:
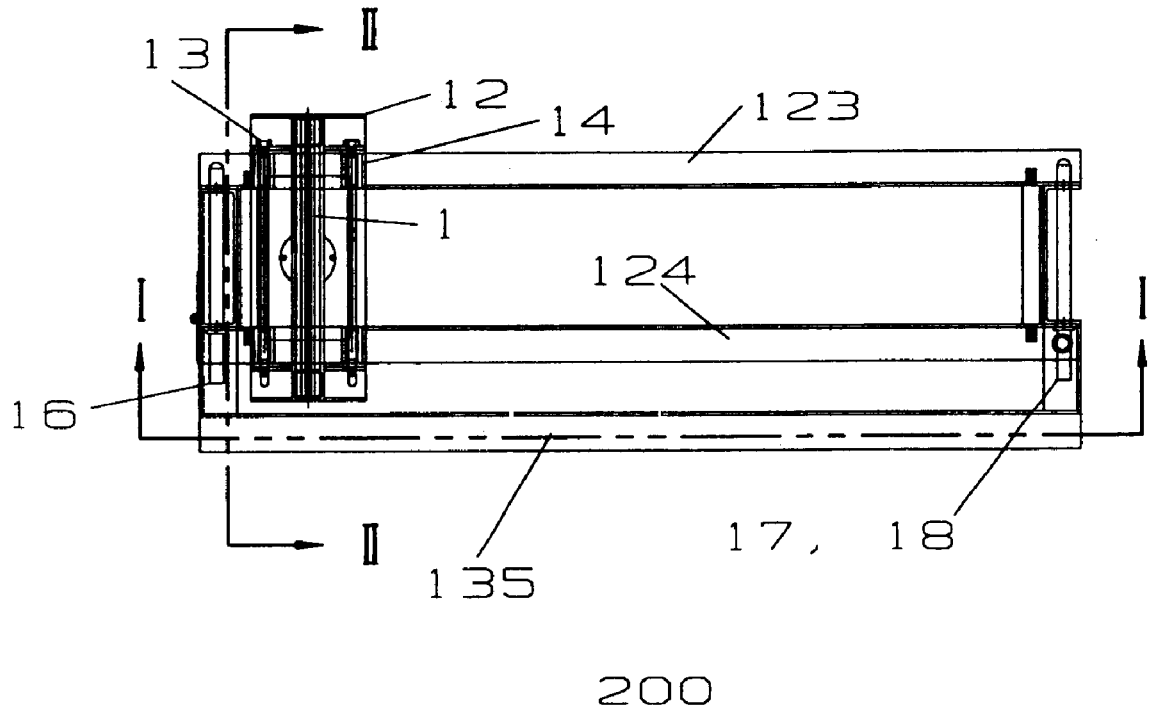
FIG. 3 is a cross-sectional view of the device taken essentially along the line 3—3 of FIG. 2, except that the platens are shown in a partially deployed position.
Figure 4:
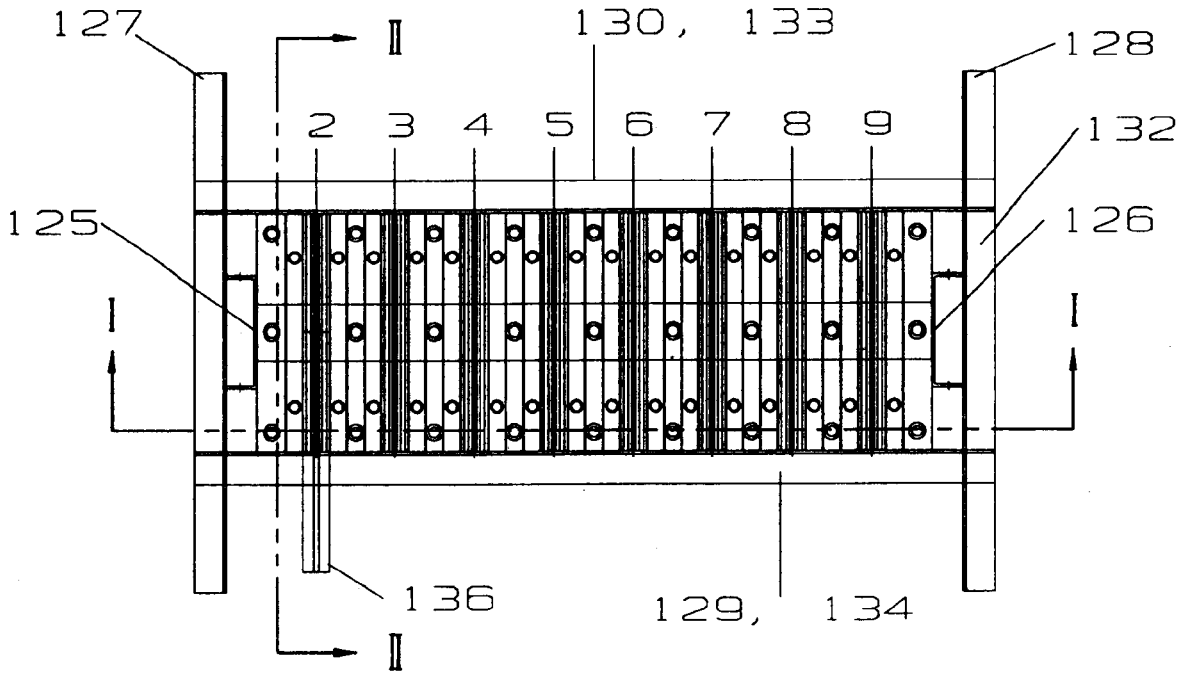
FIG. 4 is a cross-sectional view of the device taken essentially along the line 4—4 of FIG. 1.

As can be seen viewing FIG. 3, the device 200 includes platen drive mechanism assembly 122 mounted within bracket 12. Mounting bracket 12 may be attached to the respective cross beam members 123 and 124 by any conventional means such as rollers 13 and 14.

Figure 5:
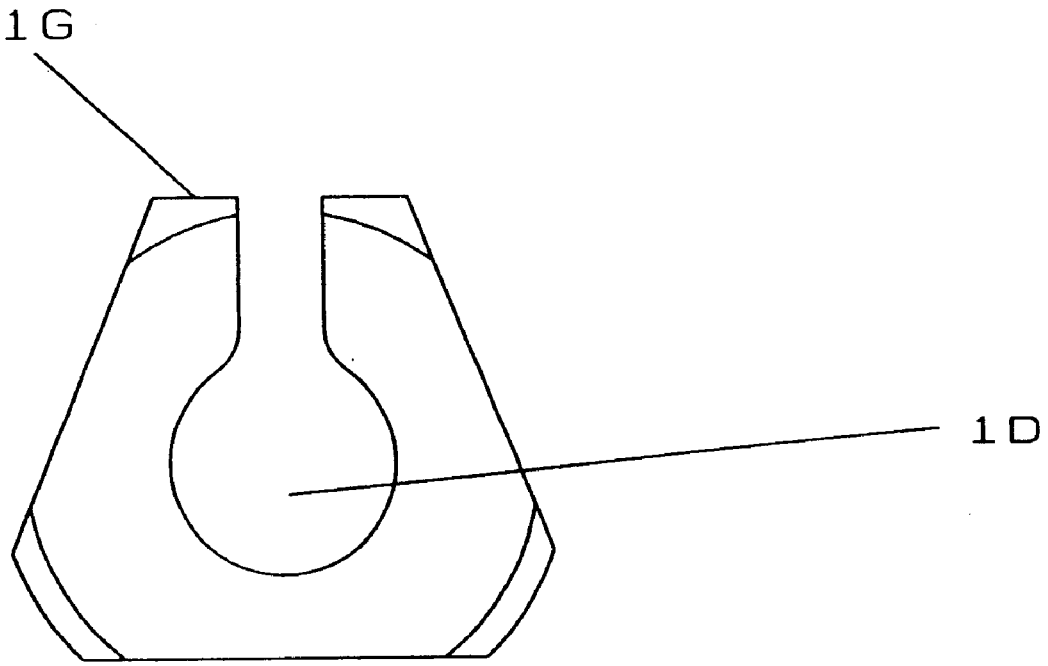
FIG. 5 is a cross-sectional view of a typical platen of FIG. 1.

The device 12 also includes reciprocally driven platen 1 and multiple recessible platens 2–9. These platens are best illustrated in FIGS. 1 and 5.

Reciprocating platen drive mechanism assembly 122, may be actuated by any art-known means, including mechanical, hydraulic, or pneumatic devices or a combination that generates mechanical advantage, and is mechanically coupled to platen 1. Thus, platen drive mechanism assembly 122, actuates, through extension of plunger 122A, movement of platen 1, toward one of platens 2–9 to which it is in aligned opposition, within the same plane of action.

Bale contacting surfaces of platen 1 and it's aligned opposite have a major axis extending transversely with respect to their supporting bases and are in substantial alignable opposition relative to one another (see FIG. 1). Each platens 1 and 2 through 9, have a longitudinally extending bale tie receiving recess 1D therein; this recess being dimensioned for ready placement of the bale tie during the process of bale repair and subsequent removal of the repaired bale from the device thereafter. As shown in FIG. 5, the platens, in a preferred embodiment, maybe generally triangular in cross-section, with their respective basal dimensions being wider than their respective compressive surface 1G. While the invention is not limited to this configuration, it is particularly desirable as it provides strength to the platen while minimizing compression surface area.

Figure 6:
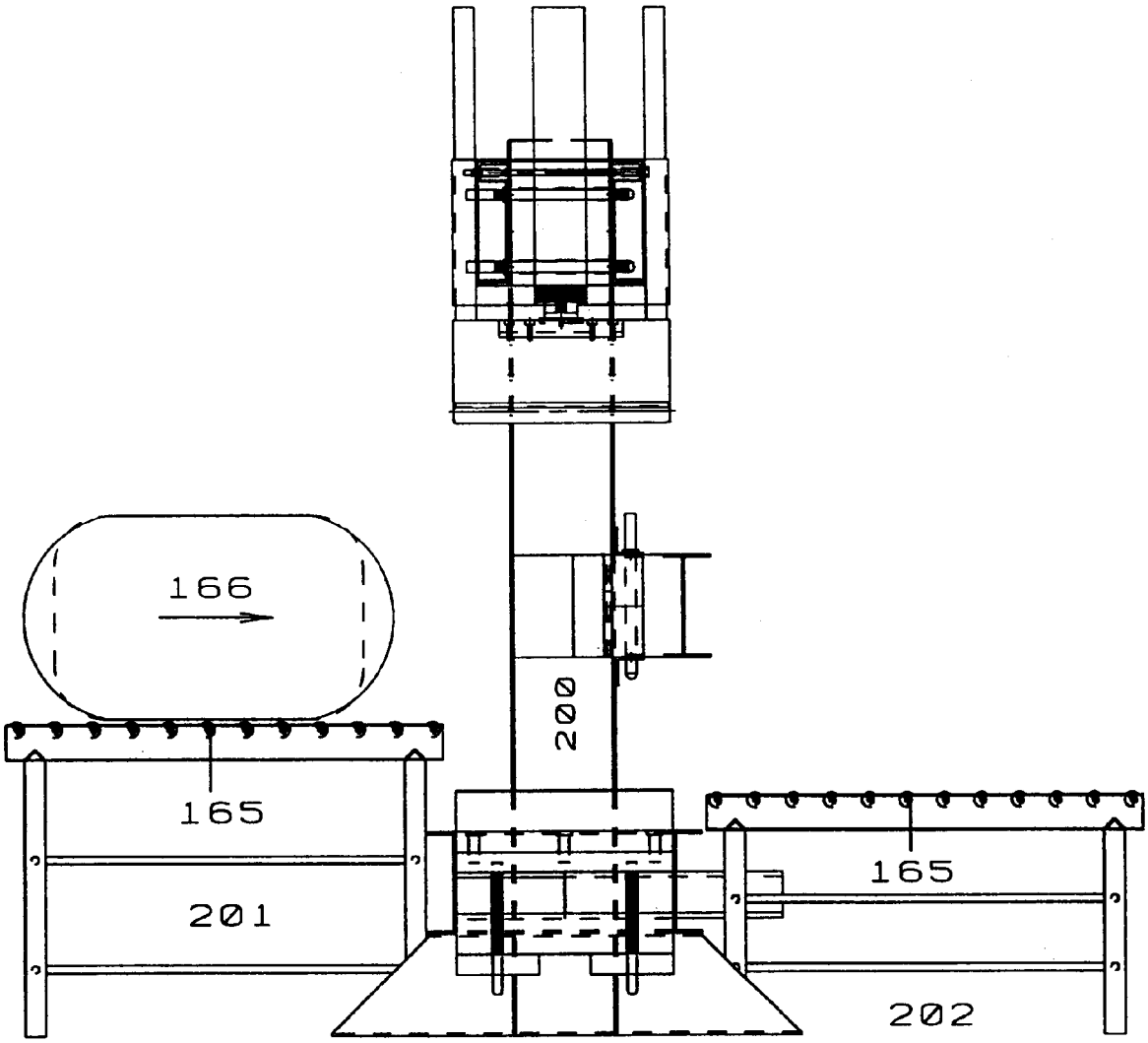
FIG. 6 is an expanded view of FIG. 2 further illustrating the relationship of infeed and outfeed bale conveyer mechanisms.
Figure 7:
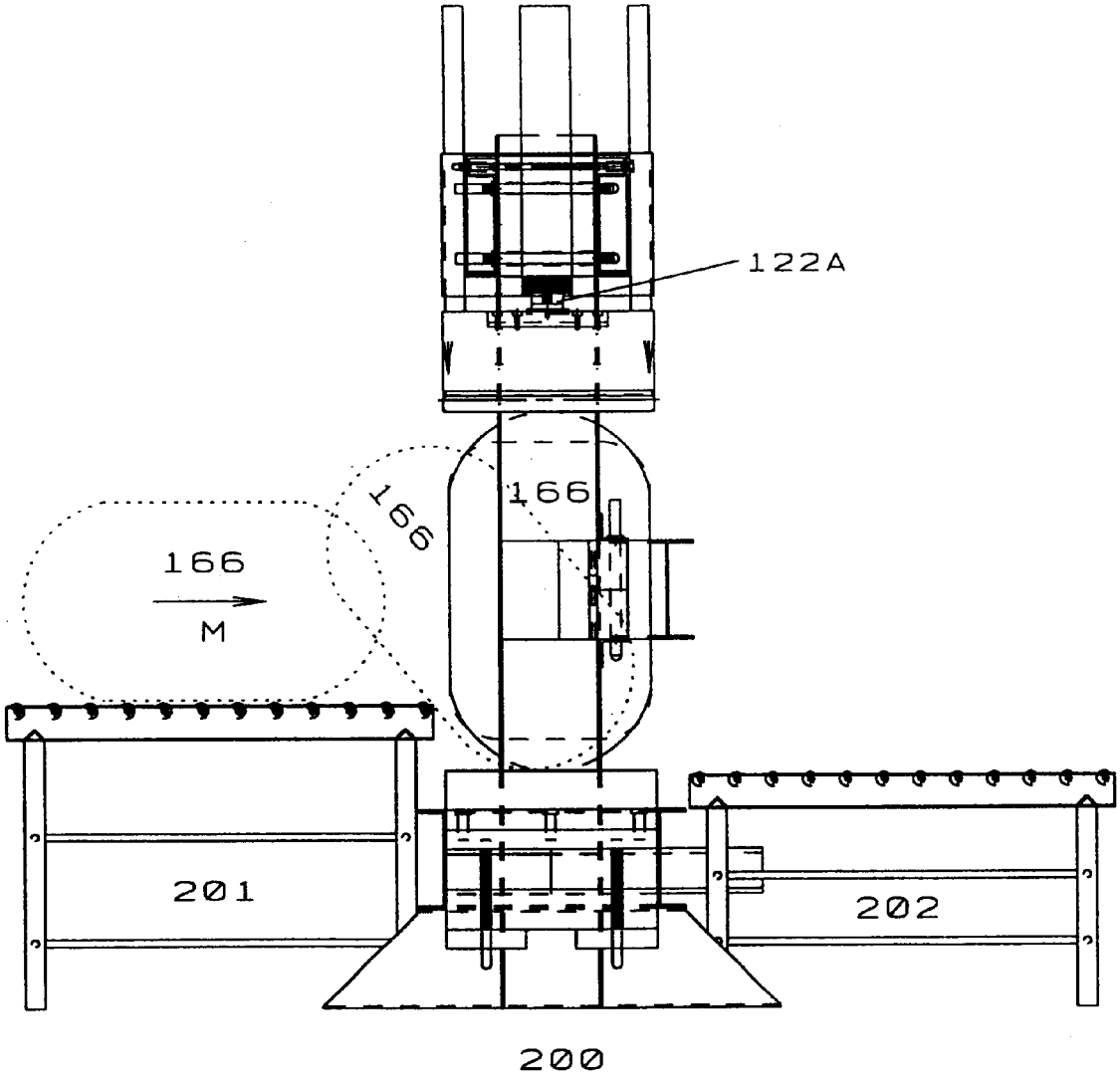
FIG. 7 is a view similar to FIG. 6, except that in this case a damaged bale is illustrated before and after the bale is positioned in the repair device.

With reference to FIGS. 6 and 7, the device 200 may be equipped with conveyor apparatuses 201 and 202, which are situated beside base frame members 127 and 128. The conveyor 201 is disposed to transport a bale 166 into the repair zone, located between platens 1 and 2 through 9. The purpose of the conveyor apparatus 201 is to move the bale 166, into the repair zone. To do this the platen drive mechanism must be in a substantially retracted condition so as to provide clearance for the bale 166.

In accordance with the invention, bale 166 is moved in the direction of the arrow M in FIG. 7 while the platen drive mechanism for platen 1 is fully retracted so that the bale 166 and the platens assume the positions shown in FIG. 1. Rollers 165 may be mounted on the conveyors 201 and 202 as shown to facilitate movement of the bale into and out of the zone of repair. Platen 1 with its associated platen drive assembly 122 is then horizontally translocated along cross beam members 123 and 124 to be placed in direct opposition to the desired platen of platens 2 through 9.

The chosen platen of platens 2 through 9 is then physically locked in its extended position above the surface of the platen base. Locking of the platen may be accomplished by any standard means in the art such as by shims, pins, cams, locks, rods or movable counter cylinders. Cylinder assembly 122 is then actuated to move platen 1 toward its chosen counterpart of platens 2 through 9. The two opposing platen surfaces are brought into compressive contact with bale 166 and at the area of desired bale compression, where a bale tie inserted through bale tie receiving recess 1D of both platens is then secured. During compression, non-selected balance of platens 2 through 9 reversibly recess below the lower platen base and thus do not exert appreciable compressive force upon the bale. Upon retraction of cylinder assembly 122, compressive forces are removed from bale 166 and the non-selected balance of platens 2 through 9 return to an extended position above the lower platen base. Should an additional bale tie be needed, platen 1 with its associated platen drive assembly is moved along cross beam members 123 and 124 to a new position opposite one of the previously unselected lower platens 2 through 9, with the previously selected lower platen being unlocked so as to allow it to reversibly recess into the platen base and the newly selected platen being locked so as to prevent this. Platen surfaces are dimensioned so as to compress a damaged bale only in close proximity to the area where a single tie is to be placed. The width of platen surfaces should typically be no more than about 2 inches and preferably may be about 1 inch.

Platen surfaces of platen 1 and it's selected opposing platen of platens 2 through 9, are thus positioned for compressing a damaged bale therebetween, as cylindrically driven platen 1 moves within the same plane as it's aligned opposite. Likewise, platen drive mechanism assembly 122 is operable to move platens 1 so that a bale 166 is compressed between the opposing platen surfaces.

Conveyors 201 and 202, shown in detail in FIGS. 6 and 7, are used for transporting a bale 166 into the repair zone. Conveyor 201, may preferably include a conveyor belt or rollers, and may be powered in a conventional manner such as by using an electric motor, hydraulic pump, or pneumatic pump. Alternatively, the bale may be pushed manually to cause translocation of bale 166 into the repair zone, via rollers 165.

Platens 1 and 2 through 9, are configured to include a bale tie receiving recess 1D, whereby a bale tie may be positioned prior to bale compression. In an alternate embodiment one or both of the two platens may have a cross-sectional configuration such as that which is shown in FIG. 5. Thus, this platen may have a wedge-shaped surface 1H, providing a flat or v-shaped nose portion, which is positioned to point toward the bale to be compressed.

FIGS. 6 and 7 show a table equipped with a bed of rollers 165, that may be positioned adjacent the device 200 to assist in removing the bale from the apparatus after the bale has been repaired.

Thus, the invention provides a transportable, mobile device for recompressing a bale of material such as cotton, only in an area proximate to the desired compressive area and allowing a tie to be applied. In accordance with the invention, the device includes compression platens that are preferably and desirably only about 1.0 inches wide and about 21 inches long, with a 0.25-inch wide longitudinal recess on the bale contact surface to allow a replacement tie to remain concealed during compression. Through the use of such a platen, only about 1.9% of the bale face needs to be compressed. Sufficient force is applied to the effected area of the bale so as to compress it to a thickness of 19–20 inches. A new tie is then applied and secured, and the bale is released.

When four ties are broken on a typical damaged bale, the bale may expand to a height of approximately 40 inches. The force required for compression of the bale in a defective area increases exponentially as a function of cotton density. Tests conducted using a platen having a length of 21 inches, a compression width of 4 inches and a 1 inch longitudinally extending bale tie receiving recess in the center of the compression surface provided the following data:

TABLE I

| Test No. | Force applied, tons | Platen separation achieved, inches |
|---|---|---|
| 1 | 6 | 26.25 |
| 1 | 10 | 25.25 |
| 1 | 12 | 24.38 |
| 1 | 20 | 23.44 |
| 2 | 0 | 26.59 |
| 2 | 5 | 25.03 |
| 2 | 10 | 23.62 |
| 2 | 15 | 22.62 |
| 2 | 16 | 22.19 |
| 3 | 5 | 26.54 |
| 3 | 10 | 25.00 |
| 3 | 15 | 23.88 |
| 3 | 20 | 22.81 |

To determine the significance of the width of the platen compression surface, further tests were conducted using a 21 inch long platen having a compression surface width 0.875 inches, and a 0.25 inch center groove. These tests provided the following further data:

TABLE II

| Test No. | Force applied, tons | Platen separation achieved, inches |
|---|---|---|
| 4 | 0 | 0 |
| 4 | 5 | 23.25 |
| 4 | 10 | 21.75 |
| 4 | 15 | 20.50 |
| 4 | 20 | 19.75 |

An analysis of the foregoing data suggests strongly that the compression area should be as small as possible, depending primarily on the strength and ability of the platen itself to withstand the forces to which it is subjected. Thus, a platen which has a generally triangular cross-sectional configuration is preferred to provide a compression surface having a minimal compression area, coupled with maximum strength.

I claim:

1. A device for inserting or replacing bale ties without repetitive shifting of the bale within the device, said device comprising:

a base frame structure;

a single reciprocally driven upper platen transversely movable upon said base frame structure along a line perpendicular to the planes of said ties for paired contraposition with a lower platen;

a lower platen base attached to said base frame structure containing a plurality of lower platens; each platen being provided with elongated, generally longitudinally extending bale contacting and compressing surfaces having a longitudinally extending major axis, with said upper platen being mounted on said structure for reversible translation toward and away from an opposable lower platen within a common plane of action, with said platen compression surfaces being disposed in substantial parallelism to one another and with said surfaces located in substantial alignment and positioned for compressing a bale of material therebetween, as the upper platen moves toward an opposed lower platen, said surfaces each having a dimension in a direction perpendicular to the major axis thereof, which is sufficiently small so as to compress a bale of material only in close proximity to a location where a single bale tie is to be placed;

a drive mechanism for moving said upper platen perpendicular to the planes of said ties and for positioning said upper platen in substantial alignment with any single one of said lower platens;

and a reciprocating drive mechanism that is coupled to the upper platen, to move the upper platen toward said single one of said lower platens to thereby compress a bale of material between said surfaces.

2. A device as set forth in claim 1, wherein said lower platens are attached to said lower platen base in such a manner as to allow for them to compressibly recede into recesses present in the lower platen base.

3. A device as set forth in claim 2, wherein said lower platens are reversibly maintained above the lower platen base by spring tension.

4. A device as set forth in claim 2, wherein said lower platens are reversibly lockable in a position where they extend above the lower platen base.

5. A device as set forth in claim 1, wherein a longitudinally extending bale tie receiving recess is provided in each of said platen compression surfaces.

6. A device as set forth in claim 1, wherein said reciprocating drive mechanism comprises a mechanical, hydraulic, or pneumatically operated cylinder assembly.

7. A device as set forth in claim 1, wherein said device includes a conveyor apparatus situated beside said base frame structure and disposed to transport a damaged bale into the plane of repair located between said platens.

8. A device for inserting or replacing bale ties without repetitive shifting of the bale within the device, said device comprising:

a base frame structure;

an upper platen transversely locatable upon said base frame structure for paired contraposition with a lower platen;

a lower platen base attached to said base frame structure containing a plurality of lower platens; each platen being provided with elongated, generally longitudinally extending bale contacting and compressing surfaces having a longitudinally extending major axis, with said upper platen being mounted on said structure for reversible translation toward and away from an opposable lower platen within a common plane of action, with said platen compression surfaces being disposed in substantial parallelism to one another and with said surfaces located in substantial alignment and positioned for compressing a bale of material therebetween, as the upper platen moves toward an opposed lower platen, said surfaces each having a dimension in a direction perpendicular to the major axis thereof, which is sufficiently small so as to compress a bale of material only in close proximity to a location where a single bale tie is to be placed, wherein said lower platens are attached to said lower platen base in such a manner as to allow for them to compressibly recede into recesses present in the lower platen base and are reversibly lockable in a position where they extend above the lower platen base;

and a reciprocating drive mechanism that is coupled to the upper platen, to move the upper platen toward an opposed lower platen to thereby compress a bale of material between said surfaces.

* * * * *